US010213702B2

(12) United States Patent
Lennon

(10) Patent No.: US 10,213,702 B2
(45) Date of Patent: Feb. 26, 2019

(54) TOY RACETRACK WITH MOVEABLE LOOP PORTION

(71) Applicant: Mattel, Inc., El Segundo, CA (US)

(72) Inventor: Berrigan August Romig Lennon, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 530 days.

(21) Appl. No.: 14/505,976

(22) Filed: Oct. 3, 2014

(65) Prior Publication Data

US 2015/0097045 A1 Apr. 9, 2015

Related U.S. Application Data

(60) Provisional application No. 61/886,861, filed on Oct. 4, 2013, provisional application No. 61/985,645, filed on Apr. 29, 2014.

(51) Int. Cl.
*A63H 18/02* (2006.01)

(52) U.S. Cl.
CPC ..... *A63H 18/028* (2013.01); *A63H 18/026* (2013.01)

(58) Field of Classification Search
CPC ..... A63H 18/028; A63H 18/026
See application file for complete search history.

(56) References Cited

U.S. PATENT DOCUMENTS

| | | | |
|---|---|---|---|
| 1,431,398 | A | 10/1922 | Hetzner |
| 1,546,377 | A | 7/1925 | Gunderman |
| 1,551,002 | A | 8/1925 | Beck |
| 1,560,181 | A | 11/1925 | Marx |
| 1,561,614 | A | 11/1925 | Mahan |
| 1,565,929 | A | 12/1925 | Gunderman |

(Continued)

FOREIGN PATENT DOCUMENTS

| | | |
|---|---|---|
| EP | 261314 | 3/1988 |
| GB | 2103949 | 3/1983 |
| GB | 2494285 | 3/2013 |

OTHER PUBLICATIONS https://youtu.be/jSZoKygUelw; KanzKrew, Feb. 27, 2010, www.youtube.com.*

(Continued)

*Primary Examiner* — Gene Kim
*Assistant Examiner* — Jeffrey Vanderveen
(74) *Attorney, Agent, or Firm* — Edell, Shapiro & Finnan, LLC

(57) ABSTRACT

Disclosed is a toy racetrack having a toy vehicle launching section that, in a first configuration of the racetrack, launches a toy vehicle toward and through the open, central portion of a loop track section, preferably to impact a target, and in a transformed configuration of the racetrack, launches a toy vehicle through the track portion of the loop track section and preferably toward a catch tray. Two loop track sections are pivotably mounted to a tower, and target flags may be pivotably mounted to a loop section mounting block positioned at the top of the tower. Once one of the target flags is struck by a toy vehicle, an internal transformation mechanism is triggered that causes the loop track sections to pivot into a track engaging position in which the loop sections form terminal track portions for the track segments in the launching section of the racetrack.

20 Claims, 18 Drawing Sheets

(56) References Cited

U.S. PATENT DOCUMENTS

| | | | | |
|---|---|---|---|---|
| 1,568,492 | A | 1/1926 | Zabel | |
| 1,572,356 | A | 2/1926 | Gunderman | |
| 1,572,649 | A | 2/1926 | Gunderman | |
| 1,599,699 | A | 9/1926 | Zabel | |
| 1,599,982 | A | 9/1926 | Bauer | |
| 1,603,180 | A | 10/1926 | Zabel | |
| 2,392,722 | A | 1/1946 | Burlin | |
| 2,999,689 | A | 9/1961 | Litwinczuk | |
| 3,411,783 | A | 11/1968 | Montagna | |
| 3,621,602 | A | 11/1971 | Barcus et al. | |
| 3,677,469 | A | 7/1972 | Edmisson et al. | |
| 3,735,923 | A | 5/1973 | Brigham et al. | |
| 4,394,961 | A | 7/1983 | Muller | |
| 4,408,413 | A | 10/1983 | Hyland et al. | |
| 4,516,953 | A | 5/1985 | Hippely et al. | |
| 4,519,789 | A | 5/1985 | Halford et al. | |
| 4,558,867 | A | 12/1985 | Hippely | |
| 4,605,229 | A * | 8/1986 | McKay | A63H 18/026 446/171 |
| 5,102,133 | A | 4/1992 | Chilton et al. | |
| 5,234,216 | A | 8/1993 | Ostendorff | |
| 5,299,969 | A | 4/1994 | Zaruba | |
| 5,542,668 | A | 8/1996 | Casale et al. | |
| 5,586,923 | A | 12/1996 | Hippely et al. | |
| 5,871,385 | A | 2/1999 | Hippely et al. | |
| 5,899,789 | A | 5/1999 | Rehkemper et al. | |
| 6,241,573 | B1 | 6/2001 | Ostendorff et al. | |
| 6,358,112 | B1 | 3/2002 | Lambert et al. | |
| 6,676,480 | B2 | 1/2004 | Sheltman | |
| 6,783,419 | B1 | 8/2004 | Paukert | |
| 6,913,508 | B2 | 7/2005 | Hornsby | |
| 7,770,811 | B2 | 8/2010 | Belding | |
| 7,794,301 | B2 | 9/2010 | Ostendorff et al. | |
| 7,819,720 | B2 | 10/2010 | Nuttall et al. | |
| 7,857,679 | B2 | 12/2010 | O'Connor et al. | |
| 7,901,266 | B2 | 3/2011 | Ostendorff | |
| 7,963,821 | B2 | 6/2011 | Ostendorff | |
| 8,006,943 | B2 | 8/2011 | O'Connor | |
| 8,192,246 | B2 | 6/2012 | Ostendorff et al. | |
| 8,256,721 | B2 | 9/2012 | O'Connor et al. | |
| 8,323,069 | B2 | 12/2012 | Nuttall et al. | |
| 8,342,903 | B2 | 1/2013 | O'Connor et al. | |
| 8,382,553 | B2 | 2/2013 | O'Connor | |
| 2005/0287914 | A1 | 12/2005 | Sheltman et al. | |
| 2005/0287915 | A1 | 12/2005 | Sheltman et al. | |
| 2005/0287918 | A1 | 12/2005 | Sheltman et al. | |
| 2005/0287919 | A1 | 12/2005 | Sheltman et al. | |
| 2010/0304639 | A1 | 12/2010 | Payne et al. | |
| 2011/0086574 | A1* | 4/2011 | Nuttall | A63H 18/028 446/429 |
| 2011/0269369 | A1* | 11/2011 | O'Connor | A63H 18/026 446/429 |
| 2012/0052766 | A1 | 3/2012 | Payne | |
| 2012/0061484 | A1 | 3/2012 | Payne et al. | |
| 2012/0220183 | A1 | 8/2012 | Payne | |
| 2012/0309263 | A1 | 12/2012 | Lennon et al. | |
| 2012/0322342 | A1 | 12/2012 | De La Torre | |
| 2013/0078887 | A1 | 3/2013 | Payne | |
| 2013/0109271 | A1 | 5/2013 | Ferreyra et al. | |

OTHER PUBLICATIONS https://youtu.be/jSZoKygUelw; www.youtube.com; Feb. 27, 2010.*
https://service.mattel.com/instruction_sheets/H3618.pdf, www.service.mattel.com, Released in 2005.*

* cited by examiner

TOY RACETRACK WITH MOVEABLE LOOP PORTION

CROSS-REFERENCE TO RELATED APPLICATIONS

This application is based upon and claims priority from U.S. Provisional Patent Application Ser. No. 61/886,861 entitled "Toy Racetrack with Moveable Loop Portion," filed with the United States Patent and Trademark Office on Oct. 4, 2013, and from U.S. Provisional Patent Application Ser. No. 61/985,645 entitled "Toy Racetrack with Moveable Loop Portion," filed with the United States Patent and Trademark Office on Apr. 29, 2014, the entire disclosure of which are incorporated herein by reference in their entireties.

FIELD OF THE INVENTION

The present invention relates to toy racetracks, and more particularly to a racetrack for toy vehicles having a moveable loop track portion.

BACKGROUND

Toy racetracks are popular among children of varied ages, and a variety of track configurations have previously been provided that include various features, such as traps, loops, stunts, and the like to add to the excitement a child experiences while playing with the toy. For instance, toy racetracks have been provided having moveable track sections, and other toy racetracks have been provided that include various targets that are intended to be struck by either projectiles that are secondary to the toy vehicles or by the toy vehicles themselves in an effort to require the user to exercise some level of skill while enjoying the racetrack.

For example, U.S. Pat. No. 4,519,789 to Halford et al. discloses a toy racetrack having a moveable hoop through which the user must launch their toy vehicle.

Likewise, U.S. Pat. No. 8,192,246 to Ostendorff et al. discloses a toy racetrack including a shield that a user's toy vehicle must strike after leaving a section of racetrack in order to bounce into a receptacle.

Further, U.S. Pat. No. 8,382,553 to O'Connor discloses a toy racetrack having both moveable track portions and various projectiles, projectile launchers, and targets throughout a track relay configuration.

Still further, U.S. Patent Application Publication No. US2013/0109271 to Ferreyra et al. discloses a toy racetrack with a gap and a catapult mechanism for launching the toy vehicle across the gap.

The specifications of each of the foregoing are hereby incorporated by reference in their entireties.

While the foregoing configurations do provide various racetracks that require some exercise of skill by the user, and that are capable of varying the configuration of certain portions of the racetracks, there remains an ongoing need to provide toy racetrack features capable of maintaining the interest of a child and increasing the excitement and amusement they experience when playing with a toy racetrack. It would therefore be advantageous to provide a toy racetrack that further enhances the excitement and amusement offered to a child as they engage in such play, and more particularly that includes a loop portion that can transform from an open hoop through which the user attempts to launch their toy vehicle to a racing loop that the user attempts to traverse, requiring the user to launch their toy vehicle at the required speeds in order achieve such goals.

SUMMARY OF THE INVENTION

Disclosed is a toy racetrack that includes a toy vehicle launching section that, in a first configuration of the racetrack, launches a toy vehicle toward and through the open, central portion of a loop track section, preferably to impact a target, and in a transformed configuration of the racetrack, launches a toy vehicle through the track portion of the loop track section and preferably toward a catch tray.

In accordance with aspects of an embodiment of the invention, the reconfigurable loop track section includes two loop track sections that are pivotably mounted to a tower. Targets, such as target flags, may be pivotably mounted to a loop section mounting block positioned at the top of the tower. In a starting configuration, both loop sections are positioned in an upright, stored position, forming an open circle facing the toy vehicle launch portion of the racetrack. Likewise, in such starting configuration, each target flag is positioned so that it hangs in the open, central interior of one of the loop track sections, again facing the toy vehicle launch portion of the racetrack and presenting a target for a toy vehicle that is launched from the launching section. Once one of the target flags is struck, it pivots with respect to the loop section mounting block into an upright position, and triggers an internal transformation mechanism. That transformation mechanism causes the tower to pivot with regard to the base on which it is mounted, and likewise causes the loop track sections to pivot into a track engaging position, in which the loop sections form terminal track portions for the track segments in the launching section of the racetrack. Once the loop track sections assume that track engaging position, toy vehicles may again be launched, this time travelling along the track of the loop section, and ultimately launching from the end of the loop section toward a catch tray. Throughout play, the user must properly adjust the speed at which their toy vehicle is launched to successfully impact a target flag and/or have the toy vehicle land in the catch tray.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
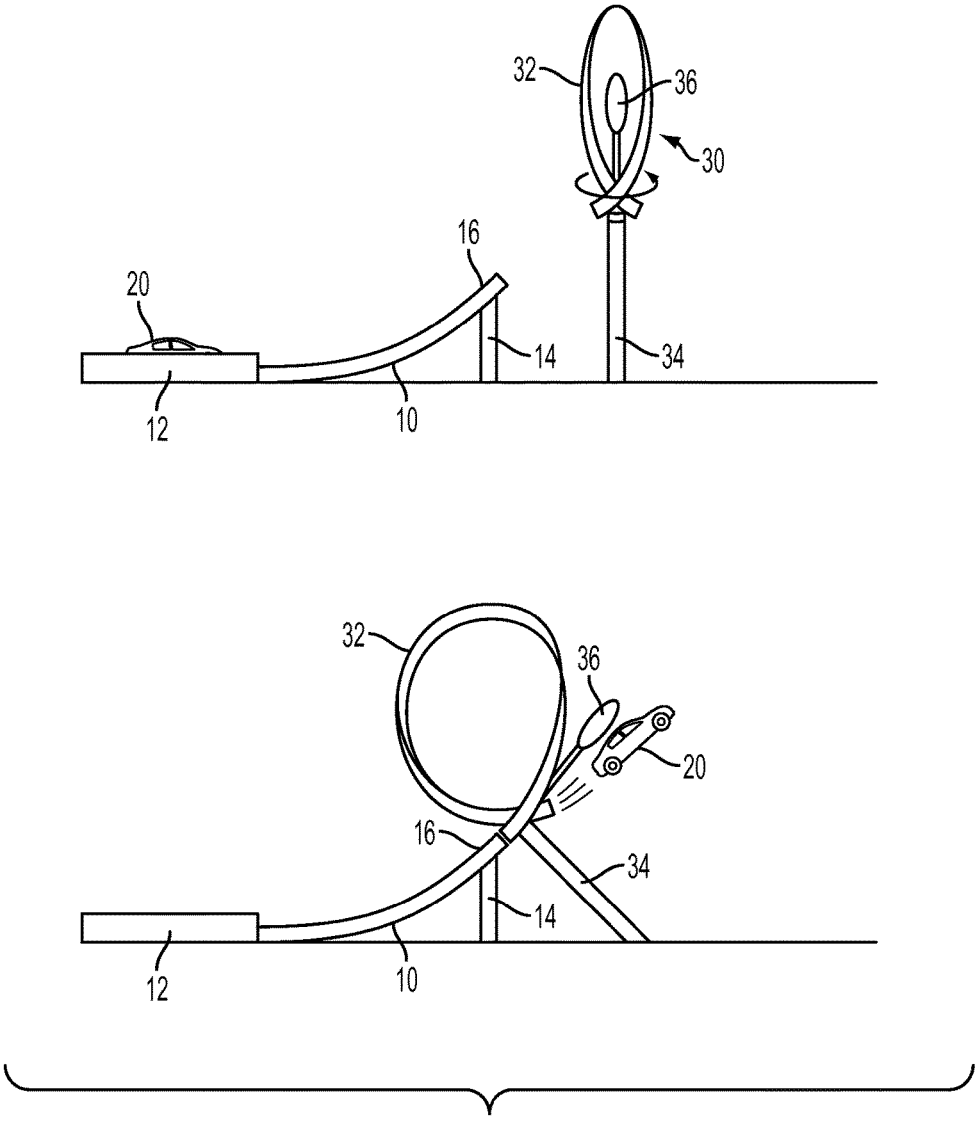
FIG. 1 is a schematic view of a toy racetrack according to aspects of an embodiment of the invention.

FIG. 1 shows a schematic view of a toy racetrack according to certain aspects of an embodiment of the invention. As shown in the top view of FIG. 1, a fixed racetrack section 10 is attached at one end to a toy vehicle launcher 12, and is attached to a support 14 at the opposite end which raises the racetrack section 10 away from a play surface so as to form a launching ramp 16 for a toy vehicle 20. A moveable loop track section (shown generally at 30) is positioned a horizontal distance away from launching ramp 16, and more particularly is positioned with respect to launching ramp 16 so as to allow a toy vehicle that launches from launching ramp 16 to, when propelled at the proper speed, interact with moveable loop track section 30. In the top view of FIG. 1, moveable loop track section is in an upright position, in which a loop 32 is positioned on a tower 34 so that the open, central portion of loop 32 faces launching ramp 16. Loop 32 is pivotably mounted with respect to tower 34, allowing it to pivot so that an entrance to loop 32 faces launching ramp 16, as described in greater detail below. A target panel 36 is also preferably provided and moveably mounted to tower 34. In the initial orientation shown in the top view of FIG. 1, target panel 34 is generally in the intended path of a toy vehicle 20 that would be launched from launching section 16, assuming the toy vehicle 20 leaves launching section 16 at the appropriate speed, which may be controlled by the user to provide an element of skill in using the toy racetrack.

If a user launches toy vehicle 20 at the appropriate speed, toy vehicle 20 will impact target panel 36, causing target panel 36 to move out of the pathway of subsequent toy vehicles that are launched from launching section 16. Likewise and preferably at the same time, and as shown in the bottom view of FIG. 1, loop 32 will pivot with respect to tower 34, and tower 34 will likewise pivot with respect to the play surface to bring loop 32 into contact with launching section 16 and forming a continuous track segment at the end of launching section 16, allowing toy vehicles 20 to travel from launching section 16 through loop 32 and on to any subsequent structure that might be provided.

Figure 2:
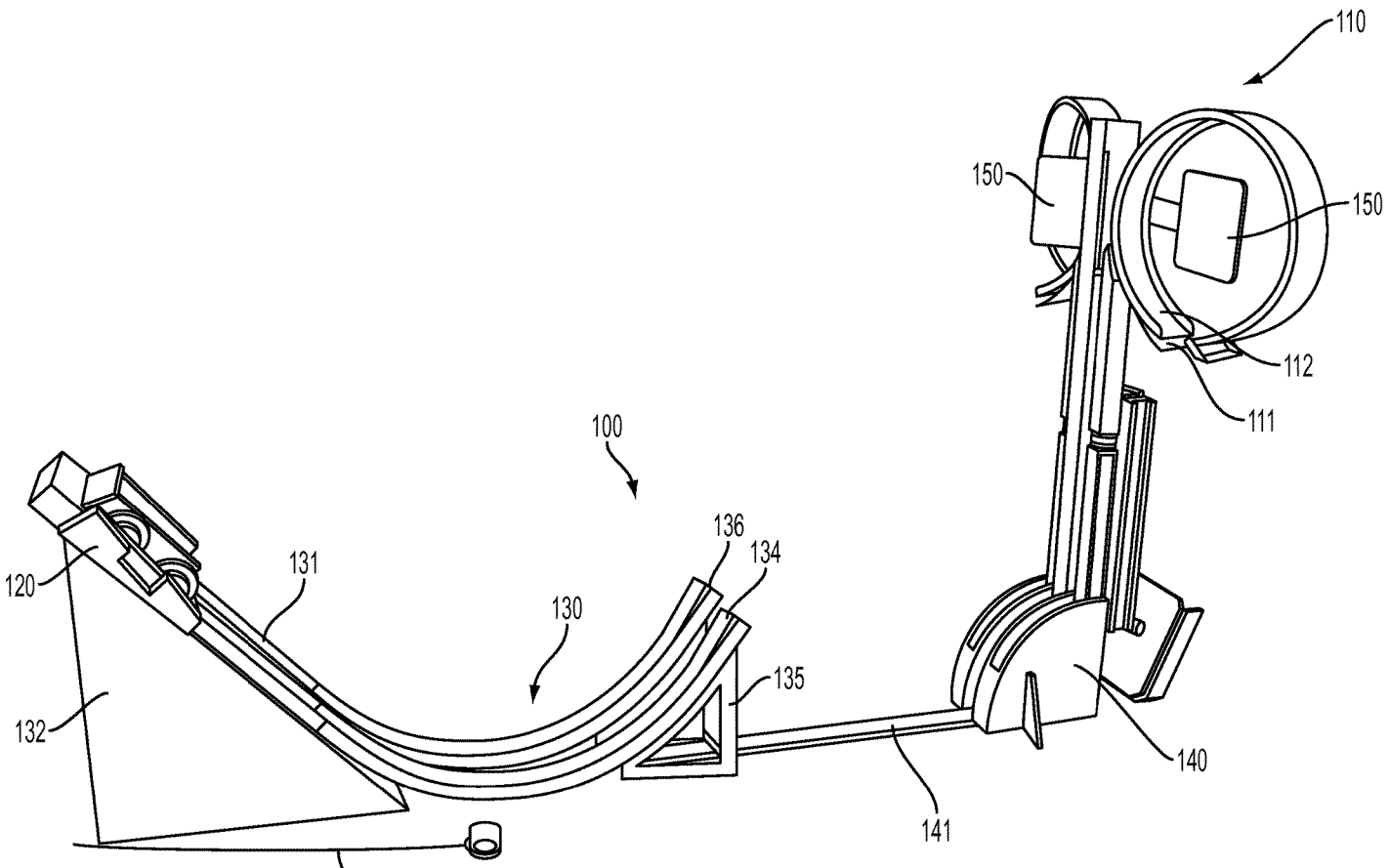
FIG. 2 is a side, perspective view of a toy racetrack according to further aspects of an embodiment of the invention, in which the moveable loop track portions are in an upright, stored position.

Next, FIG. 2 shows a toy racetrack (shown generally at 100) in accordance with further aspects of an embodiment of the invention and having a moveable loop track section 110 that is moveable from an upright, stored position in which it is not within the travel path of a toy vehicle running along the track, to a track-engaging position in which it is within the travel path of a toy vehicle running along the track. A launcher 120 is positioned at one end of a ramp track section 130, and is configured to receive a toy vehicle that may be launched by action and direction of a child or other user. The ramp track section 130 has a downwardly sloping portion extending away from the launcher, and an upwardly sloping portion at an opposite, free end of the ramp track section 130. The moveable loop track section 110 is pivotably mounted a horizontal distance away from the free end of the ramp track section, and is pivotable from the upright, stored position shown in FIG. 2 to the track engaging position shown in FIG. 3 through manual operation by a user, in which track-engaging position it forms a loop that intercepts the free end of ramp track section 130. Moveable loop track section 110 is pivotably mounted to a base 140, which base 140 includes pivotably mounted target panels 150. During play, a child may deploy moveable loop track section 110 so that it engages the free end of ramp track section 130. Thereafter, the child may launch a toy vehicle from launcher 120 while attempting to control the speed of the vehicle as it is launched so as to cause the toy vehicle to strike a target panel 150 after it launches away from moveable loop track section 110.

Figure 3:
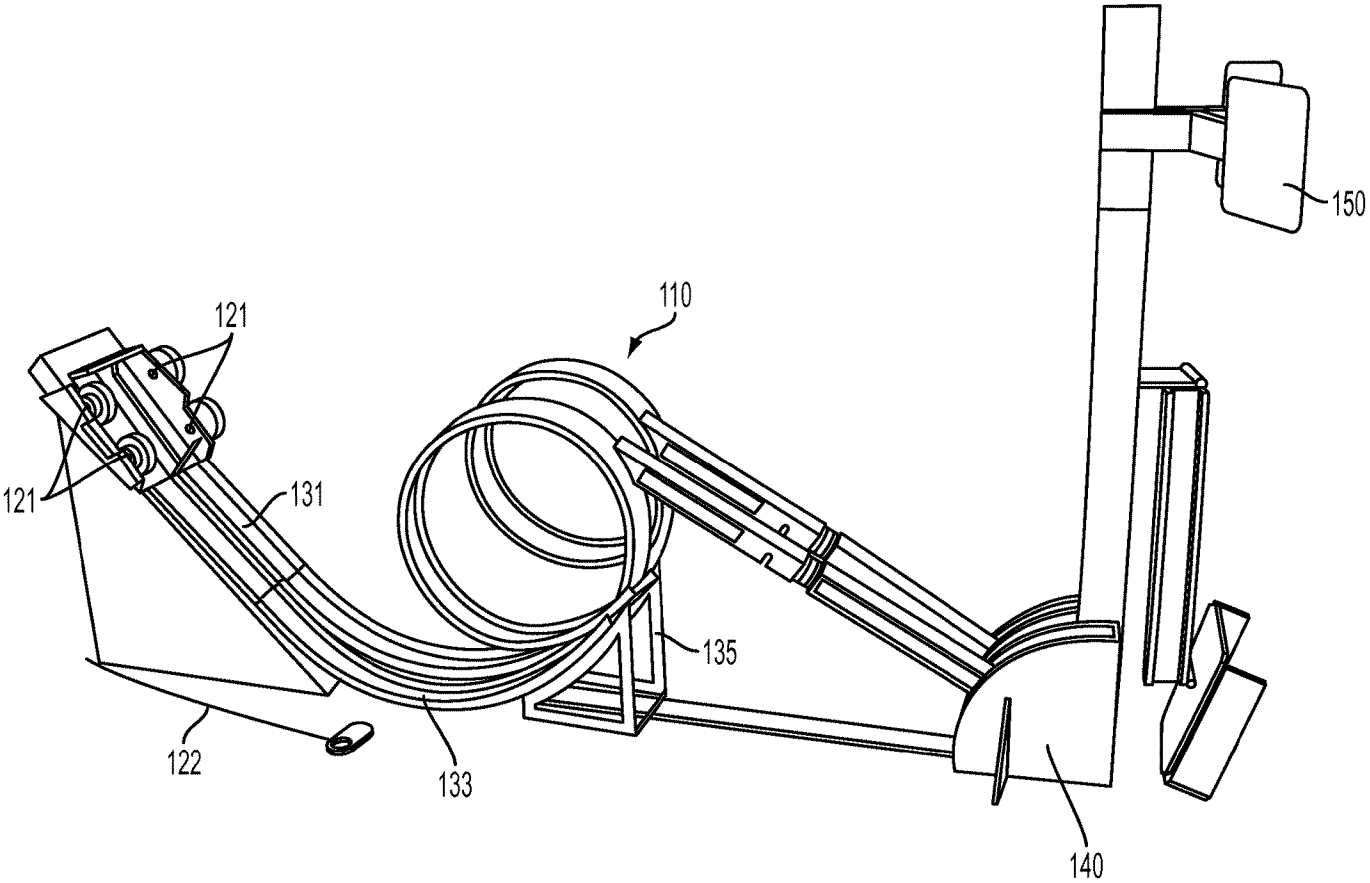
FIG. 3 is a side, perspective view of the toy racetrack of FIG. 2, in which the moveable loop track portions are in a track-engaging position.

With continued reference to FIGS. 2 and 3, ramp track section 130 is preferably formed of flexible extruded plastic track sections that may be joined together end-to-end as is well known to those skilled in the art. An entrance end 131 of ramp track section 130 is detachably connected to launcher 120, and is supported by a slanted entrance support member 132, such that gravity will assist in driving a toy vehicle through ramp section 130 after it is launched from launcher 120. Entrance end 131 of ramp track section 130 extends into mid-region 133, where it changes slope from a downward slope to an upward slope. Likewise, mid-region 133 of ramp track section 130 extends upward to free end 134 of ramp track section 130. Free end 134 of ramp track section 130 is likewise vertically supported by a free end support member 135.

Preferably, ramp track section 130 comprises two independent track sections that run parallel to one another so that two users may simultaneously race their toy vehicles along the track. Thus, support member 132 and free end support member 135 each are sufficiently wide to support at least two parallel sections of track. Moreover, while the two independent track sections may be immediately adjacent one another at entrance end 131, they will preferably diverge slightly as they approach free end 134 so as to properly align with their intended target panels 150.

As mentioned briefly above, launcher 120 is positioned adjacent entrance end 131 of ramp track section 130. Launcher 120 may have two lanes each of which is configured to receive a toy vehicle, and each such lane being aligned with one independent track section of ramp track section 130. Launcher 120 may have aligned openings 121 extending laterally across the travel path of a toy vehicle, which openings are configured to receive therethrough a pull cord 122. Pull cord 122 may be configured to engage a drive wheel of a toy vehicle, such that the speed with which a user pulls the pull cord 122 will determine the speed at which the toy vehicle is launched from launcher 120. A suitable configuration for such toy vehicles and pull cord is set forth in copending and co-owned U.S. Provisional Patent Application No. 61/818,980 filed May 3, 2014 and U.S. Provisional Patent Application No. 61/886,222 filed Oct. 3, 2013, both of which are titled "Toy Vehicle, Launching Apparatus Therefore and Methods of Using the Same," the specifications of which are incorporated herein by reference in their entireties.

Likewise, referring to FIG. 2, the free end 134 of ramp track section 130 has a loop engaging plate 136 that will rest between a track engaging plate 111 and a loop entrance track portion 112 of moveable loop track section 110, once moveable loop track section 110 is moved to the track-engaging position shown in FIG. 3.

Figure 4:
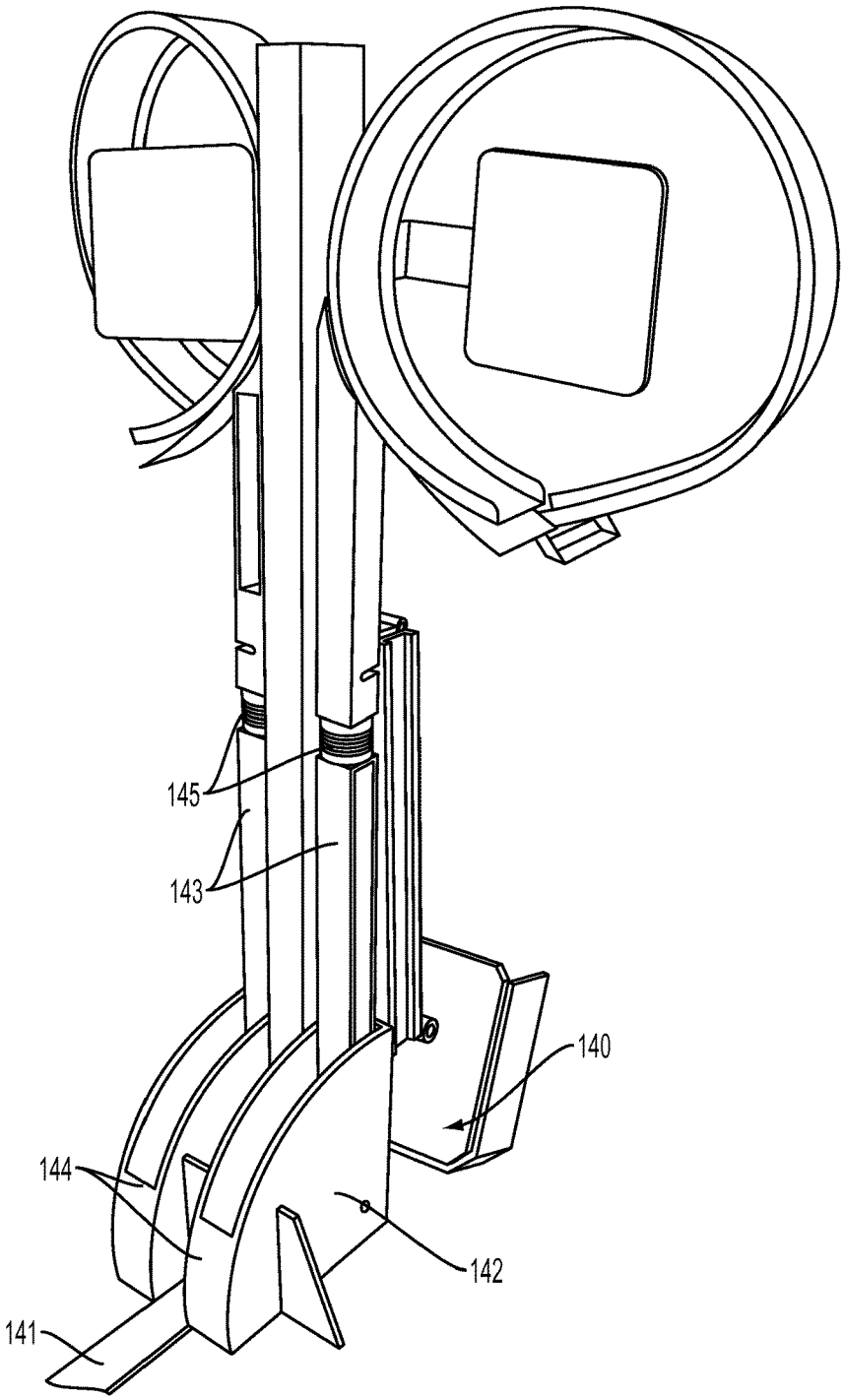
FIG. 4 is a front, perspective view of the moveable loop track portions of FIGS. 2 and 3.
Figure 5:
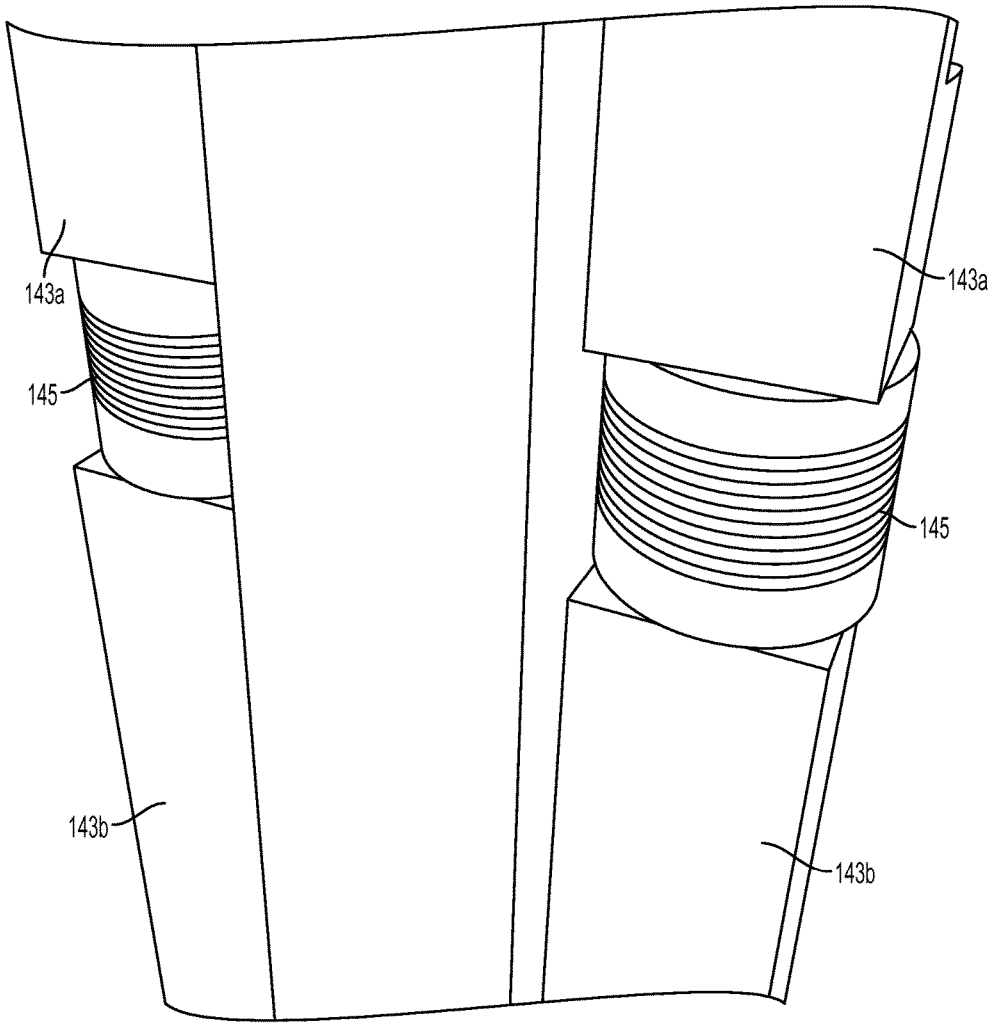
FIG. 5 is a side, perspective view of a portion of the moveable loop track portions of FIG. 4.

Base 140 is positioned a horizontal distance away from ramp track section 130, and is preferably attached to ramp track section 130 so as to maintain a fixed distance between the two. In this regard, a horizontal spacer 141 may be positioned between and connected to both ramp track section 130 and base 140. With particular regard to FIG. 4, base 140 includes pivot bracket 142 at a bottom end of base 140, which pivot bracket 142 pivotably mounts loop support arms 143, allowing them to pivot from the upright position shown in FIGS. 2 and 4 to the track-engaging position shown in FIG. 3. A stop panel 144 may be provided at the front, bottom portion of each pivot bracket to limit the downward extent to which loop support arms 143 may be pivoted. As shown in FIG. 5, a central twist coupling 145 is positioned along the mid-region of each loop support arm 143, and is configured to allow an upper portion 143*a* of each loop support arm 143 to rotate with respect to the lower portion 143*b* of the support arm 143. Moveable loop track section 110 is rigidly attached to a top end of loop support arm 143, such that pivoting the upper portion 143*a* of loop support arm 143 likewise rotates loop track section 110 into alignment with ramp track section 130. Thus, when ready for use, a child or other user may grasp one or both of moveable loop track sections 110, pivot them from the positions shown in FIG. 4 into alignment with ramp track section 130, and allow the loop track sections 110 to fall into the track-engaging position shown in FIG. 2. As the distance between ramp track section 130 and base 140 is fixed, and as loop support arms 143 are freely pivotable in pivot bracket 142, a small push by the user on the loop track section 110 toward ramp track section 130 will allow it to drop into the track-engagement position of FIG. 2, without requiring adjustment or further manipulation by the user.

Figure 6:
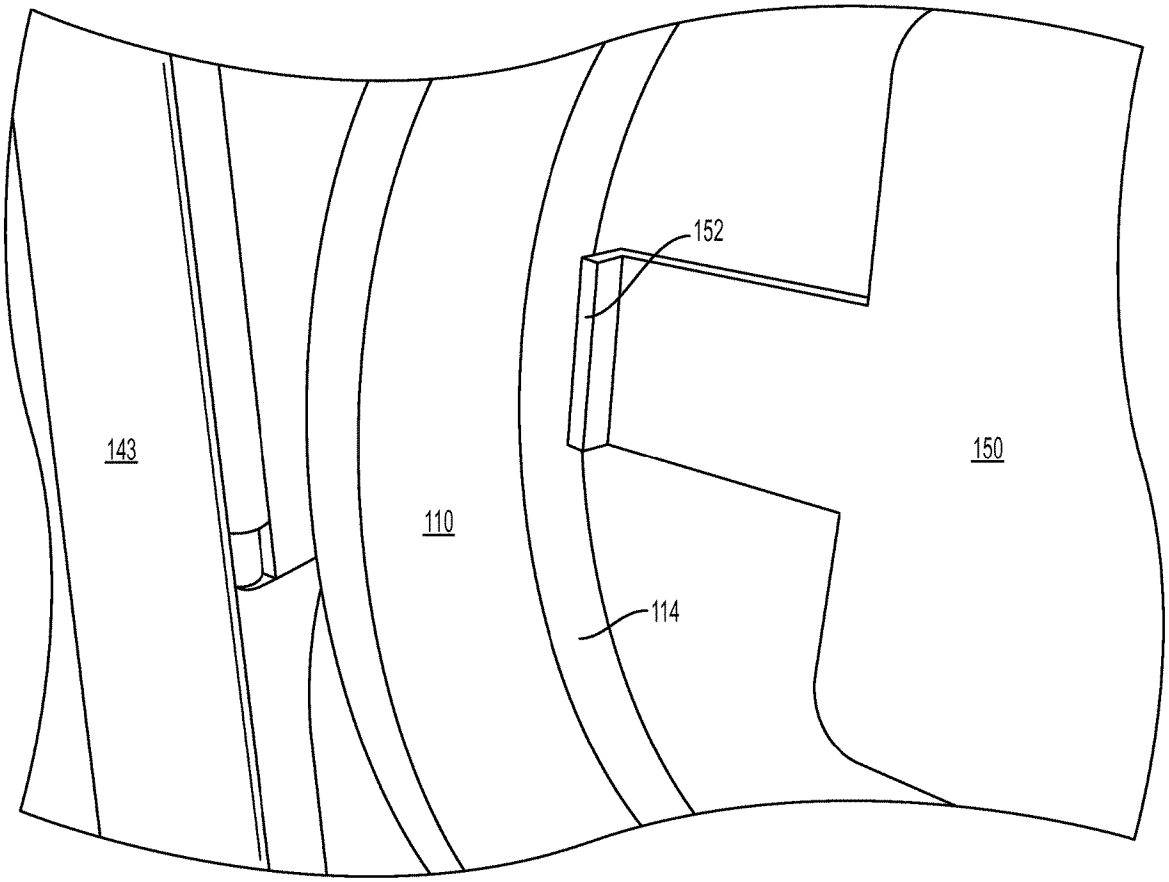
FIG. 6 is a side, perspective view of a target for use with the toy racetrack of FIGS. 2 and 3.

Next, and with particular reference to FIG. 6, target panels 150 are pivotably mounted to vertical support column 146, and are thus pivotable from a first position (shown in FIGS. 2 and 6, in which position the target panels 150 are positioned so that a toy vehicle launched from loop track section 110 at an appropriate speed will directly impact the target panel 150 in a head-on collision) in which the target panels 150 extend outward at an angle near 90 degrees from vertical support column 146, to the position shown in FIG. 3 in which the target panels 150 are angled backwards away from ramp track section 130. Thus, when a toy vehicle launched at the proper speed from moveable loop track section 110 impacts a target panel 150, it will pivot from the start position of FIG. 2 to the deflected position of FIG. 3, showing that the toy vehicle has successfully impacted the target panel 150.

To assist in holding moveable loop track section 110 in its upright position until it is intended for use, target panels 150 may each be provided a retaining lip 152 configured to engage a sidewall 114 of moveable loop track section 110. Thus, when the toy racetrack is intended for use and the user wishes to manually move moveable loop track section 110 to the track-engaging position of FIG. 3, they may push target panel 150, pivoting it with respect to vertical support column 145 and releasing retaining lip 152 from sidewall 114 of loop track section 110, pivot loop track section 110 toward ramp track section 130, and allow loop track section 110 to fall to the track-engaging position shown in FIG. 3. Thereafter, the user may reposition target panel 150 in the ready position shown in FIGS. 2 and 6, ready for impact by a toy vehicle launched from moveable loop track section 110.

Figure 7A:
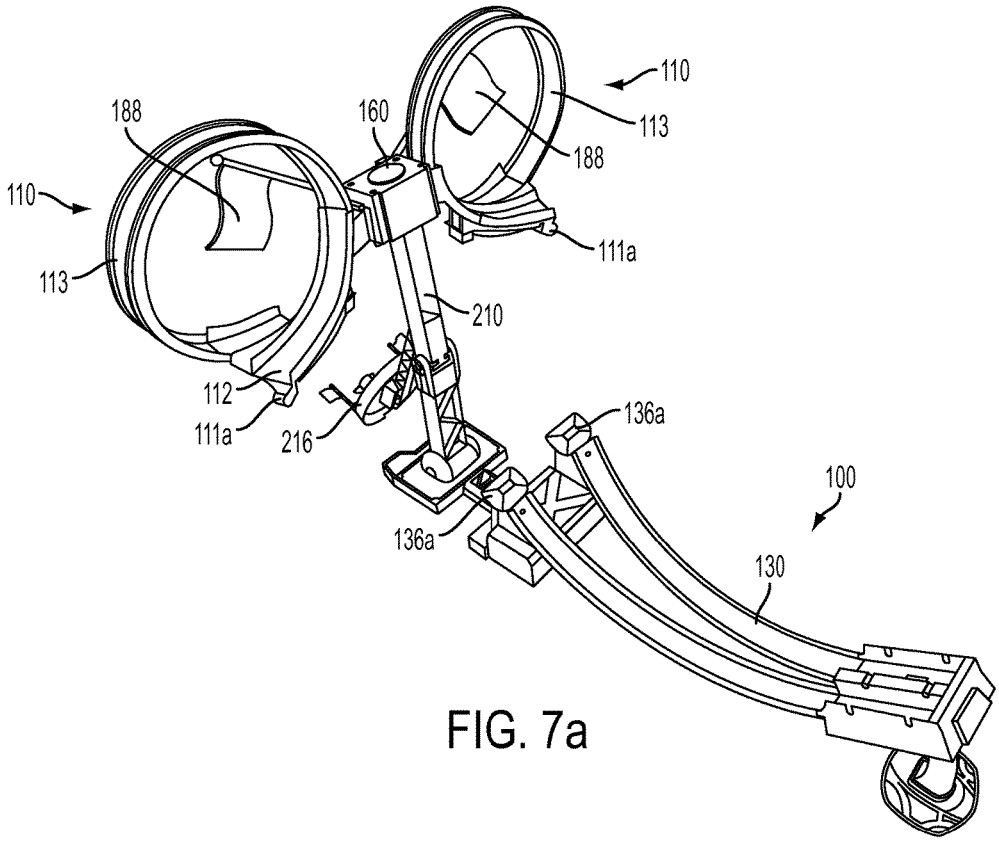
FIGS. 7*a* and 7*b* are side, perspective views of a toy racetrack according to further aspects of an embodiment of the invention, in which the moveable loop track portions are in an upright, stored position.
Figure 7B:
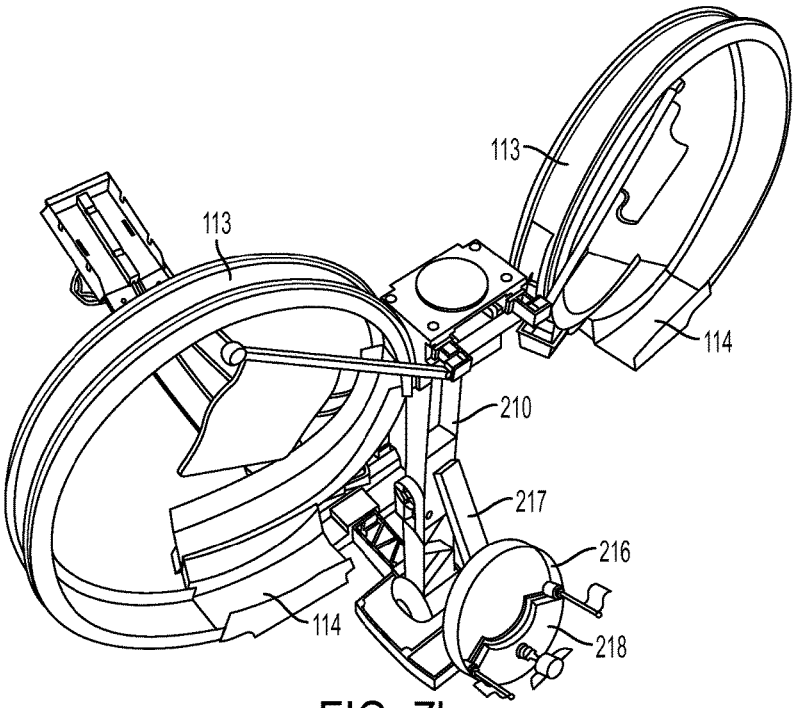
Figure 8A:
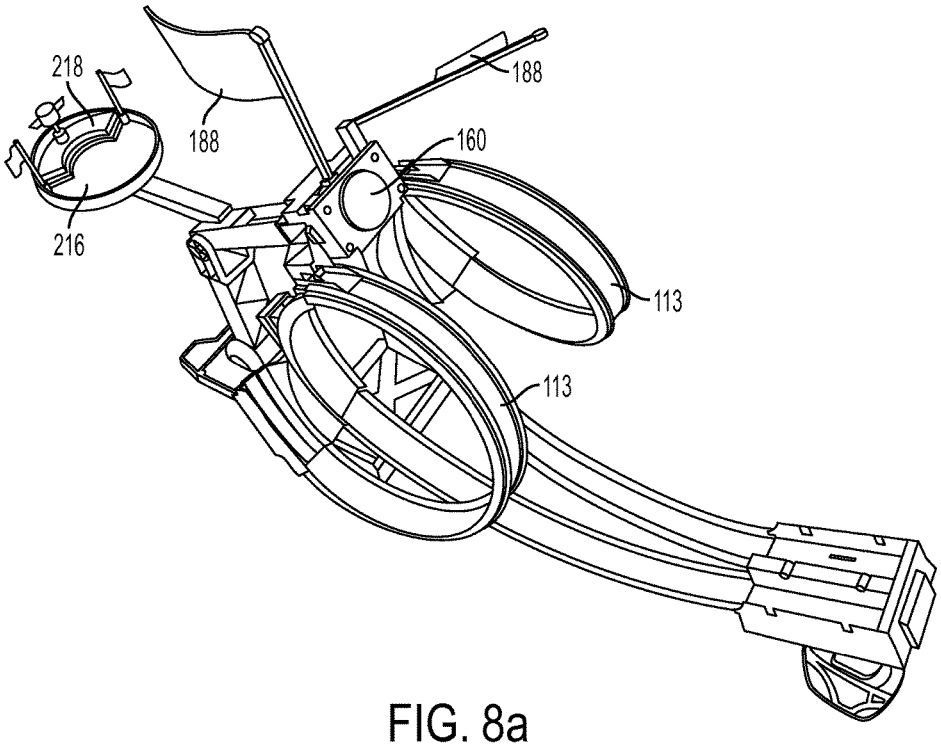
FIGS. 8*a* and 8*b* are side, perspective views of the toy racetrack of FIGS. 7*a* and 7*b*, in which the moveable loop track portions are in a track-engaging position.
Figure 8B:
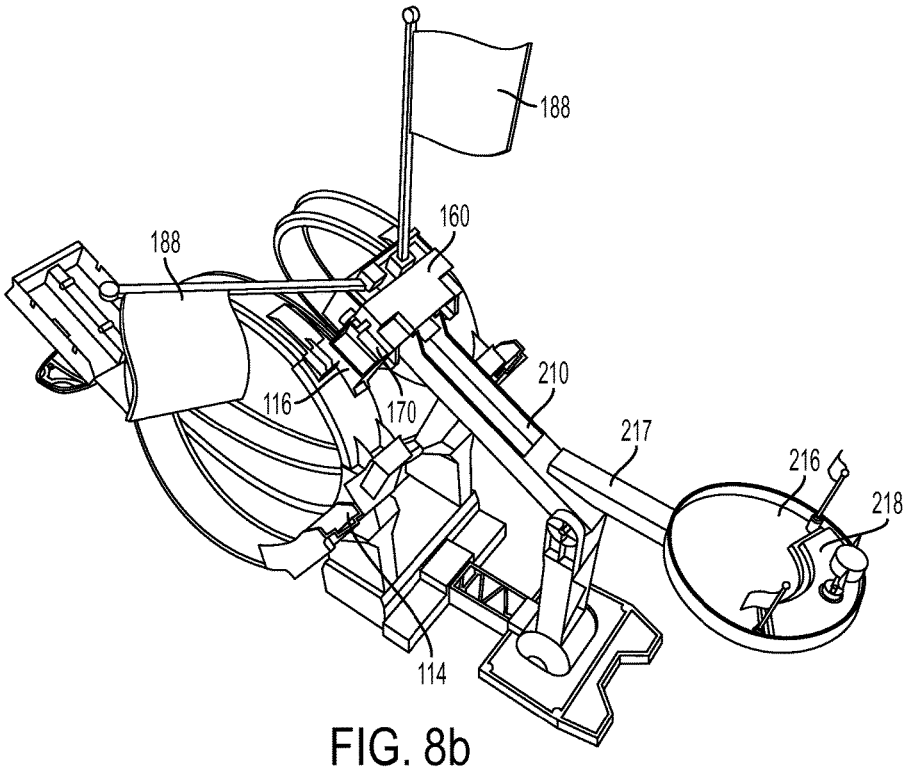

In accordance with certain aspects of the invention, and with particular reference to FIGS. 7*a* through 18*b*, toy racetrack 100 may be configured such that moveable loop track sections 110 will automatically move from their initial, upright position (as shown in FIGS. 7*a* and 7*b*) to their track engaging position (as shown in FIGS. 8*a* and 8*b*) when a toy vehicle strikes a target flag 188. As shown in FIGS. 7*a* and 7*b*, target flags 188 are mounted on a loop section mounting block 160 so that when loop sections 110 are in the initial upright, stored position of FIGS. 7*a* and 7*b*, the target flags 188 are aligned with an intended path of a toy vehicle that is launched from ramp track section 130. As will be described in further detail below, when a toy vehicle strikes one of target flags 188, the impacted target flag 188 will pivot with respect to loop section mounting block 160, causing a flag mount inside of loop section mounting block 160 to slightly push the adjacent loop track section 110 toward its track engaging position, and to engage a tower hinge release to allow the tower 210 on which the loop section mounting block 160 is positioned to pivot toward ramp track section 130. Thereafter, that same loop track section 110 adjacent the impacted target flag 188 continues under its own weight to pivot toward the track engaging position, urging tower 210 towards ramp track section 130, and in turn causing the other loop track section 110 to pivot toward its track engaging position. In such track engaging position, the target flag 188 that was struck will stand upright (as shown in FIGS. 8*a* and 8*b*), indicating which track side carried the winning toy vehicle (i.e., the first toy vehicle to have impacted a target flag 188). Thereafter, play may continue with a user launching additional toy vehicles from launcher 120, causing the toy vehicles to then travel through ramp track section 130 and loop section 110, and out from the end of loop section 110 toward a catch tray 216 with the goal of controlling the speed of the toy vehicle during the launch to ensure that it lands in catch tray 216.

As best shown in FIG. 7*a*, moveable loop track sections 110 each may be provided a base engaging tongue 111*a* configured to engage a cup-shaped receiver 136*a* on ramp track section 130, which tongue and receiver arrangement help to properly position and hold the entry portion of each loop track section 110 with respect to its respective track on ramp track section 130. The racing surface at the end of each loop track section 110 immediately adjacent tongue 111 defines loop entrance track portion 112, which leads into the racing loop and ends in a loop launch ramp 114. Loop entrance track portion 112 (holding tongue 111) and loop launch ramp 114 may be molded as a single piece, with a section of removable, extruded plastic racetrack 113 extending in a loop configuration between an exit side of loop entrance track portion 112 and an entrance side of loop launch ramp 114. Extruded plastic racetrack 113 may attach to loop entrance track portion 112 and loop launch ramp 114 in a standard tab and groove assembly as is known to those skilled in the art. As best shown in FIG. 8*b*, loop mount connector hubs 116 may be provided on the back side of each loop entrance track portion 112, each of which connector hubs 116 is configured for connection to a loop mount 170 pivotably mounted in loop section mounting block 160.

Figure 9A:
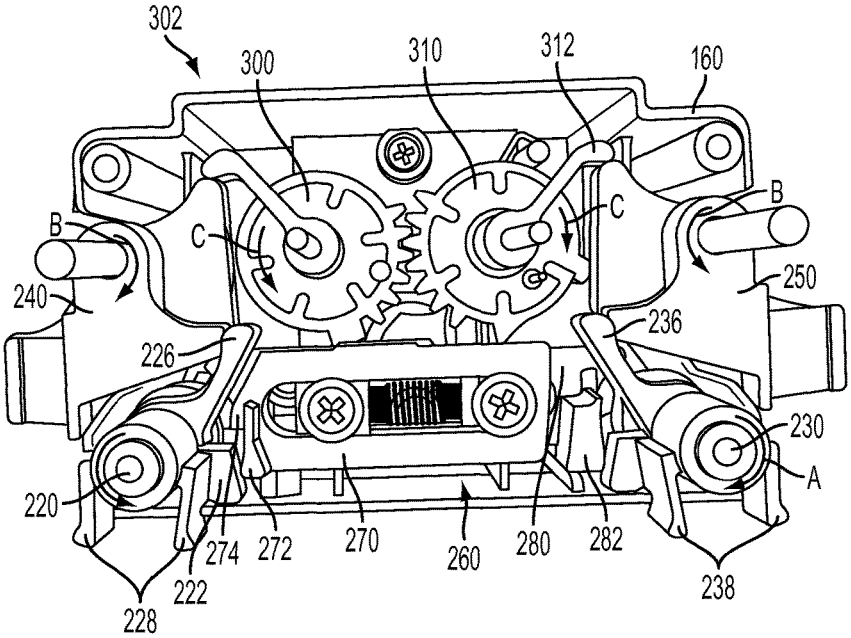
FIGS. 9*a* through 9*c* are top, sectional views of a loop section mounting block for use with the racetrack of FIGS. 7*a*, 7*b* and 8*a*, 8*b* in various positions.
Figure 9B:
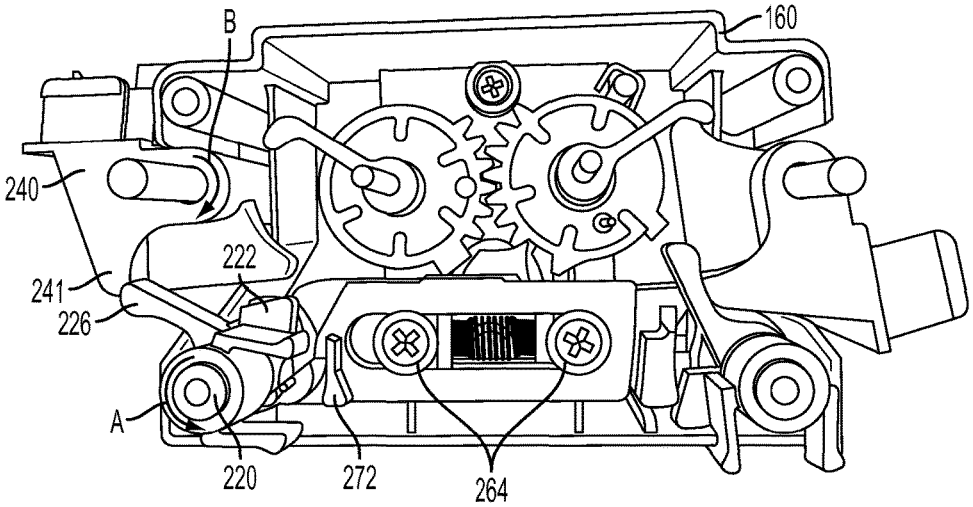
Figure 9C:
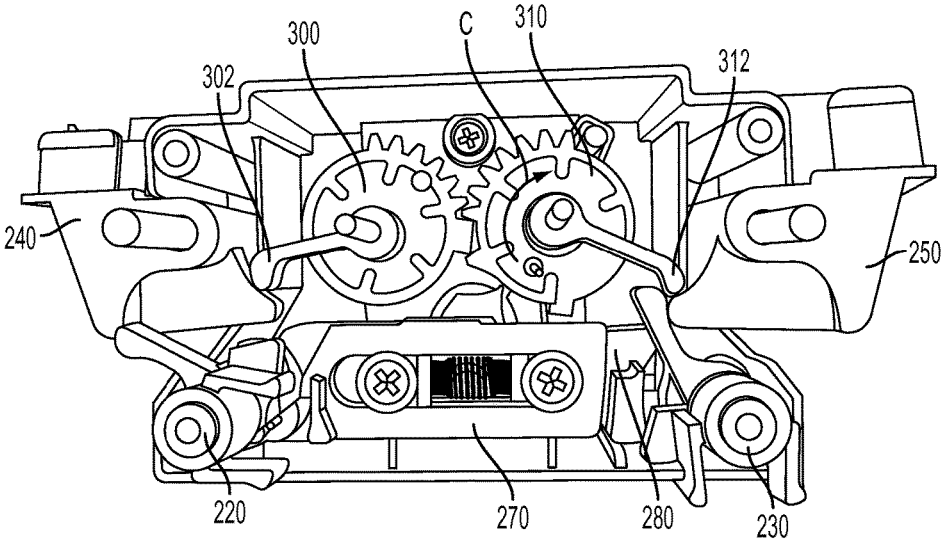

With reference to the top-down sectional views of loop section mounting block 160 of FIGS. 9*a* through 9*c*, loop section mounting block 160 pivotably mounts left flag mount 220 and right flag mount 230 such that left and right mounting clips 228 and 238 initially extend outward through a back wall of loop section mounting block 160 and are each inwardly pivotable toward one another by approximately 90 degrees in the direction of arrow A. Loop section mounting block 160 also pivotably mounts left loop mount 240 and right loop mount 250, each of which are pivotable by approximately 90 degrees in the direction of arrow B. The orientation of flag mounts 220 and 230 and of loop mounts 240 and 250 depicted in FIG. 9*a* correspond to the orientation of target flags 188 and moveable loop track sections 110 as shown in FIGS. 7*a* and 7*b*, in which both of target flags 188 are in their lowered, target positions, and both of moveable loop track sections 110 are in their facing positions with their entrances pointing away from ramp track section 130 (i.e., to the sides of loop section mounting block 160). While coil springs (not shown) bias each of left flag mount 220 and right flag mount 230 in the direction of arrow A, flag mounts 220 and 230 are likewise held in place by a slider block (shown generally at 260) which, as discussed in greater detail below, includes cam follower surfaces engaging cams on each flag mount 220 and 230, as well as catch surfaces engaging catches in each flag mount 220 and 230. Also in this position, left loop mount 240 and right loop mount 250 are each freely pivotable in the direction of arrow B, such that their respective moveable loop track sections 110 are likewise freely pivotable with respect to loop section mounting block 160.

After a toy vehicle is launched from ramp track section 130 and successfully impacts a target flag 188, a transformation mechanism (shown generally at 255) is engaged to transform the moveable loop track sections, and the device overall, from the configuration of FIGS. 7*a* and 7*b* to the configuration of FIGS. 8*a* and 8*b*, in which the impacted flag is raised and both moveable loop track sections 110 are pivoted into their track-engaging positions, while the non-impacted flag remains lowered. FIG. 9*b* shows the configuration of loop section mounting block 160, and the transformation mechanism 255, after the left target flag 188 (i.e., the target flag attached to left flag mount 220) has been impacted. As the left target flag is impacted, left flag mount 220 is urged to pivot in the direction of arrow A. As left flag mount 220 begins to pivot, a top cam 222 on left flag mount 220 pushes against an upper cam follower surface 272 on an upper slider bar 270 of slider block 260, urging upper slider bar 270 to the right (as viewed in FIG. 9*b*). As upper slider bar is pushed to the right, a lower catch surface 274 on upper slider bar 270 is also pushed to the right, releasing a catch 224 on left flag mount 220, and allowing a coil spring (not shown) to further urge left flag mount 220 in the direction of arrow A until it reaches a stop position against a portion of loop section mounting block 160.

Further, as left flag mount 220 pivots towards the stop position shown in FIG. 9*b*, a pusher arm 226 on left flag mount 220 pushes against an upper wall edge 241 of left loop mount 240, causing left loop mount 240 (and its attached loop track section 110) to pivot in the direction of arrow B and so that the loop entrance track portion 112 of its attached loop track section 110 points in the direction of ramp track section 130.

Figure 11:
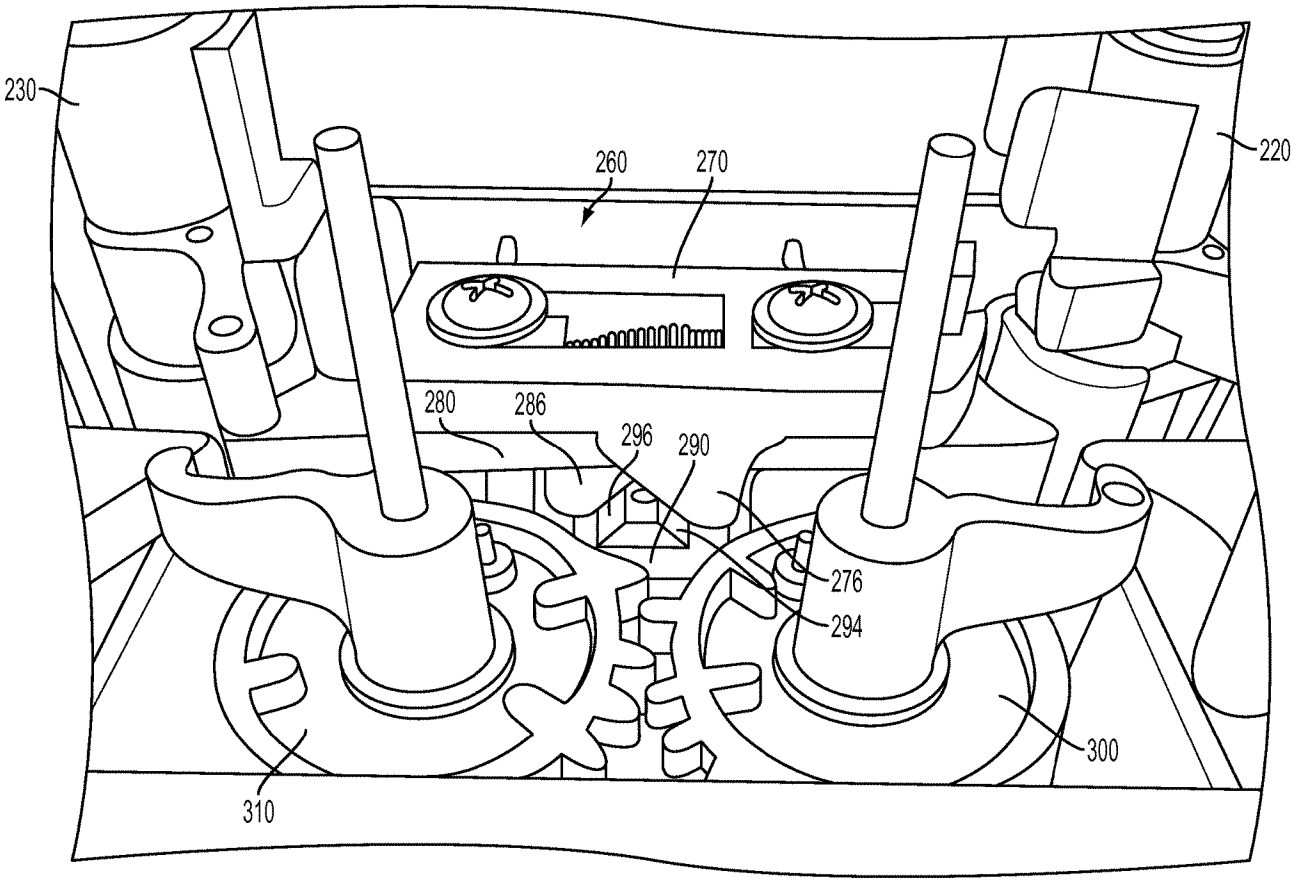
FIG. 11 is a side, sectional view of the slider block of FIG. 10.

Moreover, as upper slider bar is pushed to the right, a slanted arm 276 on the bottom side of upper slider bar 270 is moved in the same direction and engages a first angled surface 294 on plunger 290 (FIG. 11). A spring member (not shown) upwardly biases plunger 290 against the bottom of slider block 260, such that as slanted arm 276 engages first angled surface 294, plunger 290 is pushed downward. Plunger 290 also has a gear tooth 292 positioned to engage gear teeth on at least one of right pusher gear 310 and left pusher gear 300 (FIG. 9*a* showing engagement of gear tooth 292 with gear teeth of right pusher gear 310). As plunger 290 is non-rotational, it locks the position of left pusher gear 300 and right pusher gear 310 when plunger 290 is in its raised position. Likewise, when pushed downward by slider block 260, the gear tooth 292 of plunger 290 is withdrawn from right pusher gear 310, allowing left pusher gear 300 and right pusher gear to rotate. Still further, at least one of left pusher gear 300 and right pusher gear 310 is biased by a spring member (not shown) in the direction of arrow C, such that when plunger 290 releases the pusher gears 300 and 310, they will each automatically rotate in the direction of arrow C. As shown in FIG. 9*b*, as right pusher gear 310 rotates in the direction of arrow C, a pusher arm 312 on right pusher gear 310 pushes against lower wall edge 252 of right loop mount 250, causing right loop mount to pivot in the direction of arrow B.

Finally, and with reference to FIG. 9*c*, after right loop mount 250 has been pivoted by approximately 90 degrees so that the loop entrance track portion 112 of its attached loop track section 110 points in the direction of ramp track section 130, pusher arm 302 of left pusher gear 300 holds left loop mount 240 in the forward position shown in FIG. 9*c*, and pusher arm 312 of right pusher gear 310 holds right loop mount 250 in the forward position shown in FIG. 9*c*, each under the bias of the spring member (not shown) biasing right pusher gear 310 in the direction of arrow C. Notably, however, as lower slider bar 280 has not moved throughout such transformation, right flag mount 230 remains in its original position so that its attached target flag 188 remains in its lowered position.

Figure 10:
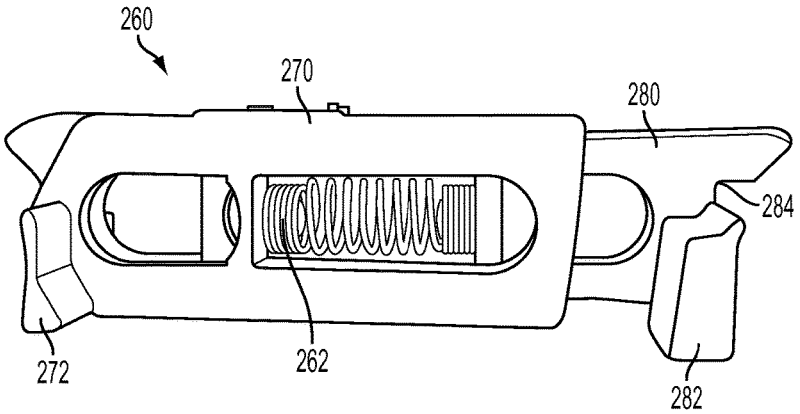
FIG. 10 is a top view of a slider block for use with the loop section mounting block of FIGS. 9*a* through 9*c*.
Figure 13A:
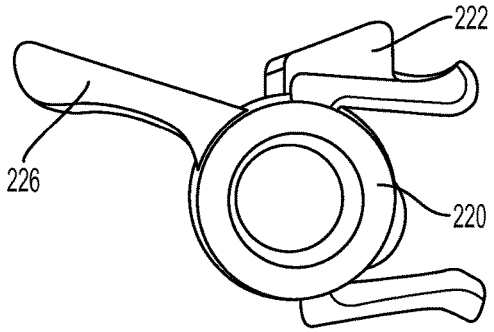
FIGS. 13*a* through 13*c* are top, left, and right views, respectively, of a left flag mount for use with the loop section mounting block of FIGS. 9*a* through 9*c*.
Figure 13B:
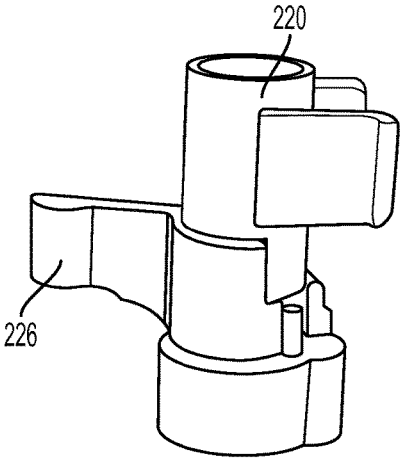
Figure 13C:
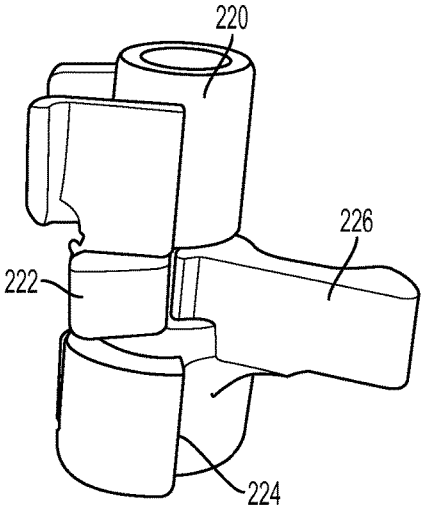
Figure 14A:
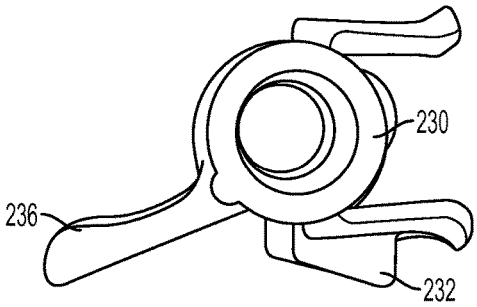
FIGS. 14*a* through 14*c* are top, right and left views, respectively, of a right flag mount for use with the loop section mounting block of FIGS. 9*a* through 9*c*.
Figure 14B:
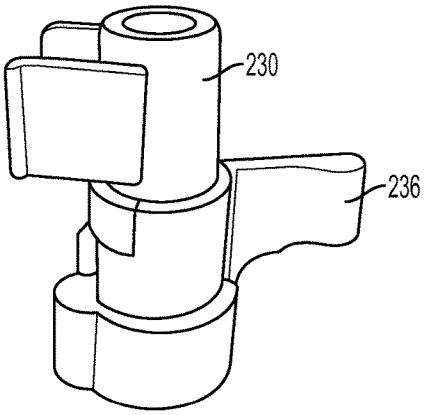
Figure 14C:
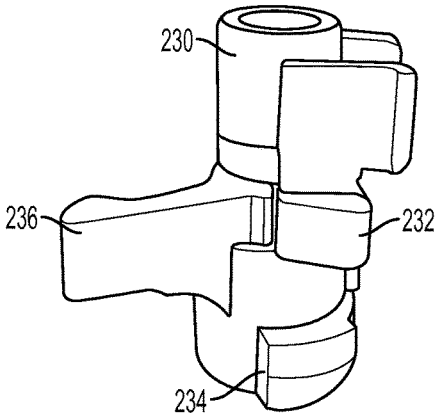

FIG. 10 shows a top view of slider block 260. Upper slider bar 270 is slidably mounted on lower slider bar 280, and the two are spring biased away from one another by slider block spring 262. Threaded members, such as screws 264 (FIGS. 9*a* through 9*c*), extend through upper slider bar 270 and lower slider bar 280 to mount slider block 260 to loop section mounting block 160 while allowing the two slider bars to move back and forth with respect to one another. As explained above, upper slider bar 270 includes upper cam follower surface 272 that engages top cam 222 on left flag mount 220, and lower catch surface 274 (best shown in FIG. 9*a*) that engages catch 224 on left flag mount 220. Similarly, lower slider bar 280 includes upper cam follower surface 282 that engages a top cam 232 on right flag mount 230, and lower catch surface 284 that engages catch 234 on right flag mount 230. FIGS. 13*a*, 13*b*, and 13*c* show close-up top, left, and right views, respectively, of left flag mount 220, including top cam 222, catch 224, and pusher arm 226. Likewise, FIGS. 14*a*, 14*b*, and 14*c* show close-up top, right, and left views, respectively, of right flag mount 230, including top cam 232, catch 234, and pusher arm 236.

FIG. 11 is a close-up, side view of slider block 260 engaging plunger 290. As explained above, plunger 290 has a first angled surface 294 in facing contact with slanted arm 276 on upper slider bar 270, and a second angled surface 296 in facing contact with slanted arm 286 on lower slider bar 280. Once again, as upper slider bar 270 is pushed away from left flag mount 220 (i.e., pushed to the left as viewed in FIG. 11), slanted arm 276 pushes against first angled surface 294 on plunger 290, pushing plunger 290 down and freeing left pusher gear 300 and right pusher gear 310 to rotate. Similarly, if right flag mount 230 is attached to the target flag 188 that is initially struck by a toy vehicle, lower slider bar 280 will be pushed away from right flag mount 230 (i.e., pushed to the right as viewed in FIG. 11), and slanted arm 286 will push against second angled surface 296 on plunger 290, pushing plunger 290 down and freeing left pusher gear 300 and right pusher gear 310 to rotate.

Figure 12A:
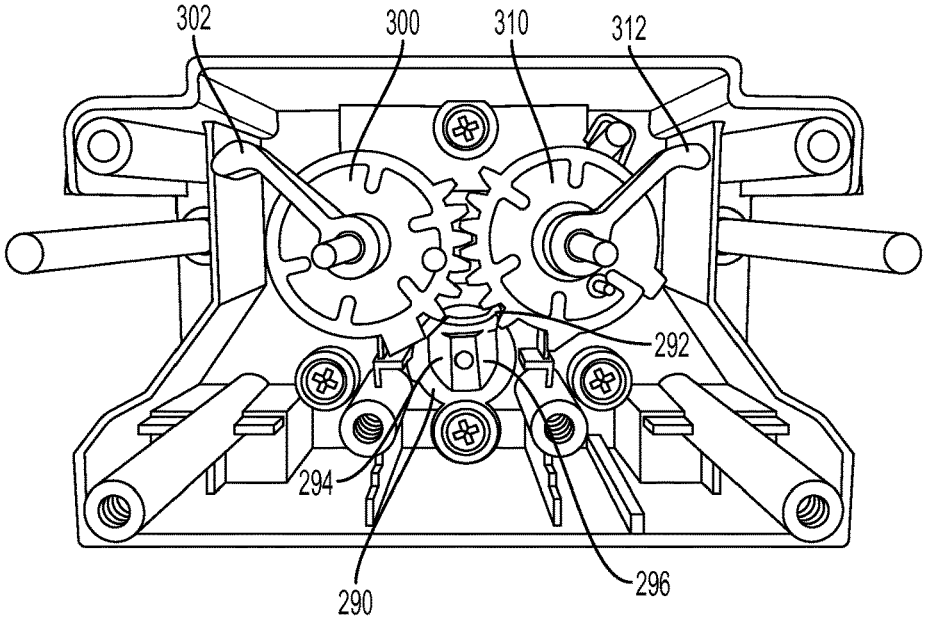
FIGS. 12*a* and 12*b* are top, sectional views of pusher gears for use with the loop section mounting block of FIGS. 9*a* through 9*c*.
Figure 12B:
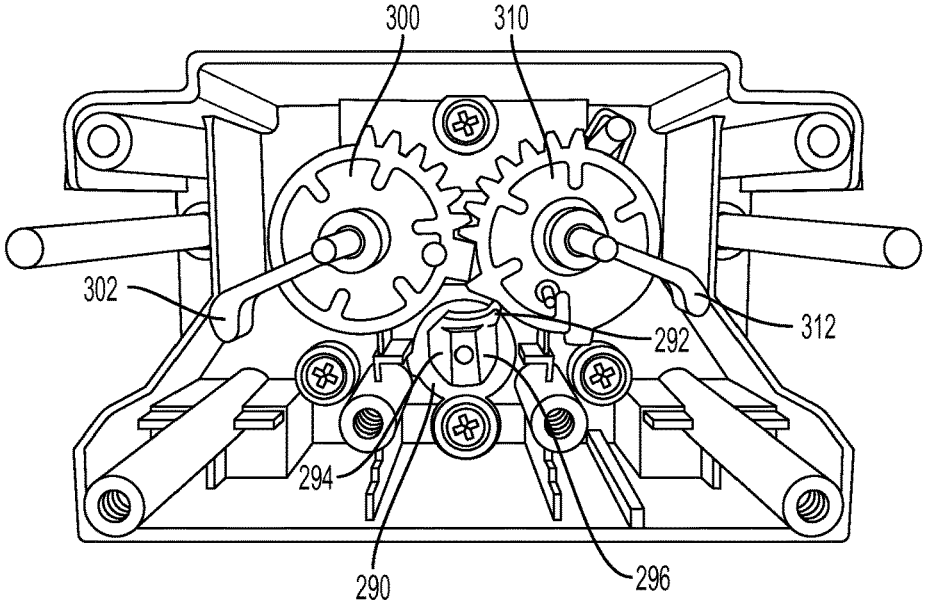
Figure 15A:
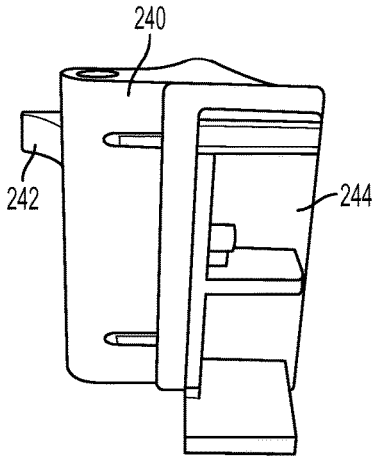
FIGS. 15*a* and 15*b* are left and front views, respectively (from the perspective of FIG. 9*a*), of a left loop mount for use with the loop section mounting block of FIGS. 9*a* through 9*c*.
Figure 15B:
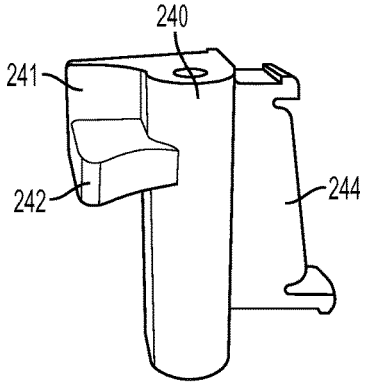
Figure 16A:
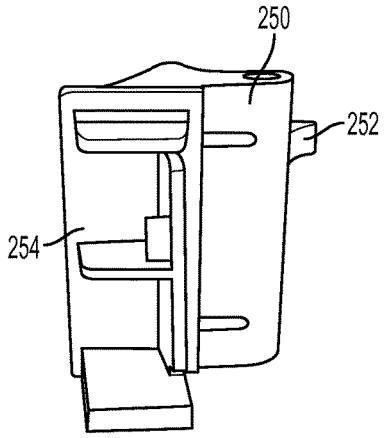
FIGS. 16*a* and 16*b* are right and front views, respectively (from the perspective of FIG. 9*a*) of a right loop mount for use with the loop section mounting block of FIGS. 9*a* through 9*c*.
Figure 16B:
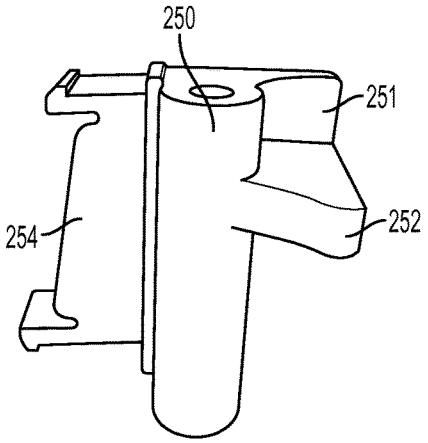

FIGS. 12*a* and 12*b* show close-up views of left pusher gear 300, right pusher gear 310, and plunger 290. As shown in FIG. 12*a*, when both target flags 188 are in the lowered position and moveable loop track sections 110 are in position with their interiors facing towards ramp track section 130 (i.e., the configuration of FIGS. 7*a* and 7*b*), plunger gear tooth 292 on plunger 290 engages the gear teeth on right pusher gear 310, preventing it (and thus left pusher gear 300) from turning. As explained above, once one of the target flags 188 is struck with a toy vehicle, either upper slider bar 270 or lower slider bar 280 will move against first angled surface 294 or second angled surface 296 of plunger 290, pushing plunger 290 downward against a spring that biases plunger 290 to its upper position. As plunger 290 is depressed, plunger gear tooth 292 drops away from the gear teeth of right pusher gear 310, allowing a spring member (biasing at least one of left pusher gear 300 and right pusher gear 310 in the direction of arrow C in FIG. 9*a*) to move left pusher gear 300 and right pusher gear 310 to the position shown in FIG. 12*b*, with their respective pusher arms 302 and 312 pushing against loop mounts 240 and 250, respectively. FIGS. 15*a* and 15*b* provide left and front views (from the perspective of FIG. 9*a*) of left loop mount 240, including upper wall edge 241 that is engaged by pusher arm 302 of left pusher gear 300, and lower wall edge 242 that is engaged by pusher arm 226 of left flag mount 220, as well as connector clip 244 configured for attachment to loop mount connector hubs 116. Likewise, FIGS. 16*a* and 16*b* provide right and front views (from the perspective of FIG. 9*a*) of right loop mount 250, including upper wall edge 251 that is engaged by pusher arm 312 of right pusher gear 310, and lower wall edge 252 that is engaged by pusher arm 236 of right flag mount 230, as well as connector clip 254 configured for attachment to loop mount connector hubs 116.

In addition to automatically causing the transformation described above, in which both loop mounts 240 and 250 are automatically pivoted to their track-engaging positions upon a single target flag 188 being struck, the transformation mechanism 255 simultaneously releases a catch between tower 210 and base 140, allowing tower 210 to pivot towards ramp track section 130 and allowing the moveable loop track sections to engage their respective cup-shaped receivers 136*a* as shown in FIGS. 8*a* and 8*b*. More particularly, and with reference to FIGS. 17*a* through 17*d*, the top of tower 210 mounts loop section mounting block 160. The bottom of loop section mounting block 160 has an opening 162 (shown in FIGS. 18*a* and 18*b*) allowing a hinge release mechanism (shown generally at 320 in FIGS. 17*a* through 17*d*) to engage a release tab 314 extending downward from a bottom of one of left pusher gear 300 and right pusher gear 310, such that as left pusher gear 300 and right pusher gear 310 rotate during the transformation process, the hinge release mechanism 320 is simultaneously engaged to lift a catch (not shown) at the base of tower 210 that extends into base 140, in turn allowing tower 210 (and moveable loop track sections 110) to pivot downward toward and ultimately engage ramp track section 130.

Figure 17A:
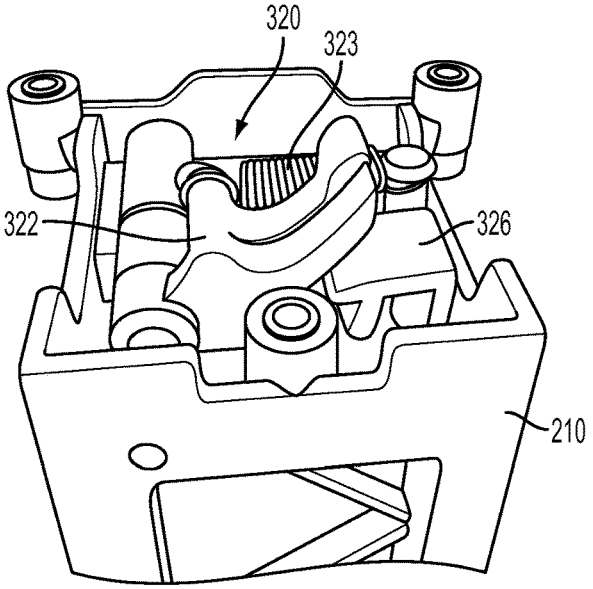
FIGS. 17*a* through 17*d* are perspective views of a hinge release mechanism for use with the loop section mounting block of FIGS. 9*a* through 9*c*.
Figure 17B:
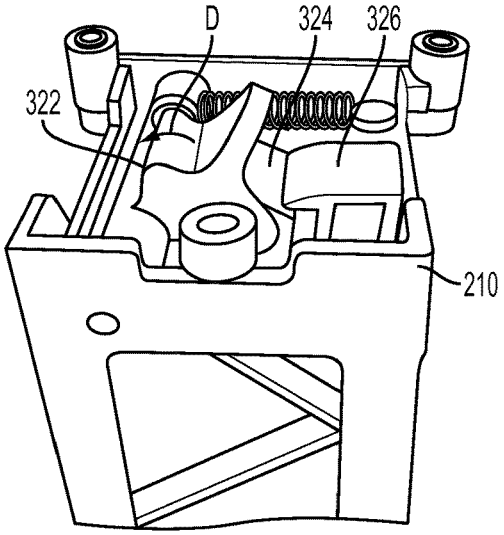
Figure 17C:
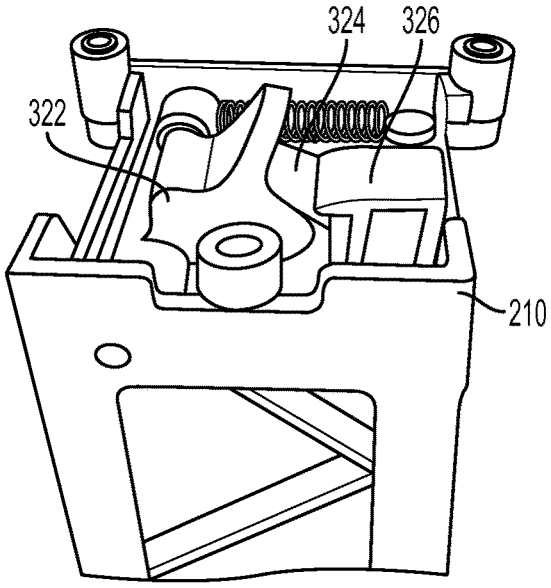
Figure 17D:
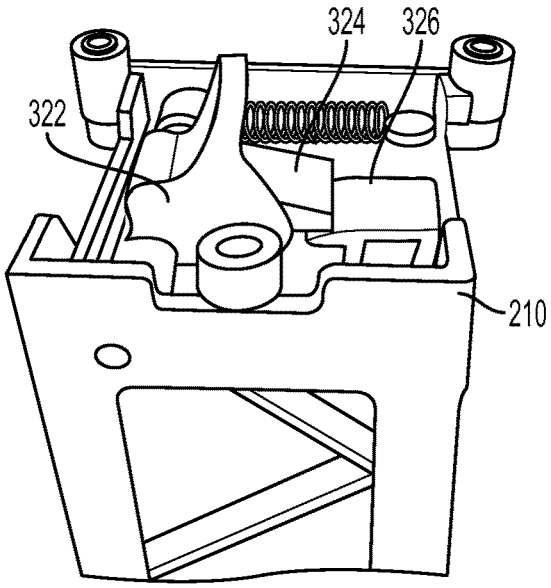
Figure 18A:
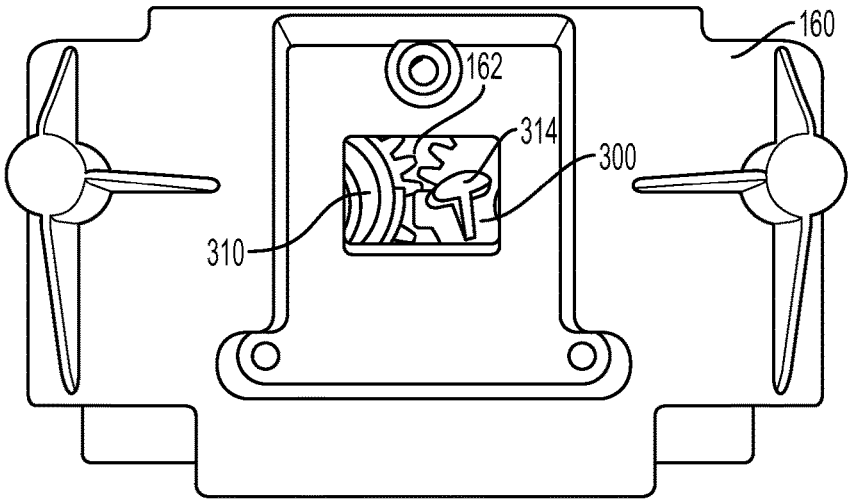
FIGS. 18*a* and 18*b* are bottom views of the loop section mounting block of FIGS. 9*a* through 9*c*.
Figure 18B:
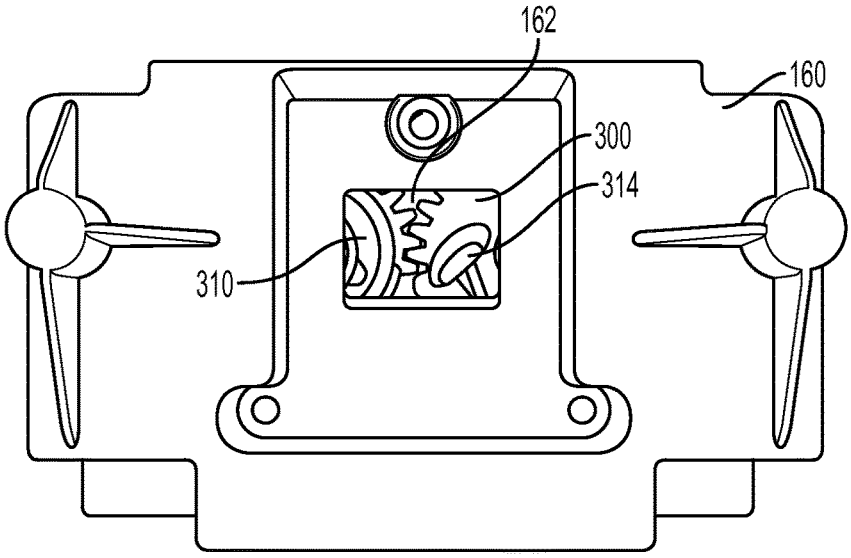

With particular reference to FIGS. 17*a* through 17*d*, hinge release mechanism 320 includes a pivotably mounted rocker arm 322 that is biased by a spring 323 toward a holding position (shown in FIG. 17*a*) in which the base-engaging catch is in an engaged position. As left pusher gear 300 and right pusher gear 310 rotate, release tab 314 likewise changes position, moving from the position shown in FIG. 18*a* to the position shown in FIG. 18*b*. As release tab 314 is moved, it lifts rocker arm 322, causing it to pivot in the direction of arrow D (FIG. 17*b*). As rocker arm 322 pivots, a finger 324 lifts carrier 326. An opposite end of carrier 326 carries the base-engaging catch, such that lifting of finger 324 mechanically translates to lifting of such catch away from base 140, allowing tower 210 to pivot with respect to base 140. As shown in FIG. 17*c* (showing finger 324 engaging carrier 326 just before carrier 326 is released), carrier 326 raises only a short distance in order to release the base-engaging catch, and thereafter allows carrier 326 to drop back towards tower 210. However, as tower 210 immediately begins to pivot toward ramp track section 130 as soon as the base-engaging catch releases, carrier 326 moving back down in tower 210 will not reengage base 140 until tower 210 is manually reset to its upright position. Moreover, and with reference to FIGS. 17*c* and 17*d*, carrier 326 may move slightly from left to right in tower 210, such that when rocker arm 322 is released from release tab 314 on left pusher gear 300 and pivots back to the ready position of FIG. 17*a*, finger 324 will slightly push carrier 326 away to allow finger 324 to slip back under the top edge of carrier 326.

Referring again to FIGS. 7*a*, 7*b*, 8*a* and 8*b*, a catch tray 216 is mounted to the back side of tower 210 on a catch tray support arm 217. Catch tray support arm 217 extends outward from the back side of tower 210 at an angle, such that it will assume a generally horizontal position when the tower 210 and loop track sections 110 are pivoted forward to the track engaging position (shown in FIGS. 8*a* and 8*b*). Catch tray 216 may optionally include a stepped rear wall 218 at the far edge of the catch tray 216, which serves as a stop surface for catching a toy vehicle as it lands in catch tray 216. Catch tray 216 may also be slidably positionable along catch tray support arm 217, allowing it to be moved closer to or further away from loop track sections 110. In such varied positions of catch tray 216, a player will be required to adjust the speed at which they launch their toy vehicle if they are to successfully land the vehicle in catch tray 216, thus adding to the challenge and interest afforded a player when engaging the toy racetrack.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

What is claimed is:

1. A toy racetrack comprising:

a toy vehicle launch section;

a support tower positioned a distance away from said toy vehicle launch section;

a loop track section pivotably mounted to said support tower for movement between a first position in which the loop track section does not engage the toy vehicle launch section and a second position in which the loop track section forms a continuous track portion at an exit end of said toy vehicle launch section; and a target flag pivotably mounted to said support tower, said target flag having a first position in which said target flag is in alignment with the exit end of said toy vehicle launch section when said loop track section is in said first loop track section position, wherein said target flag is mechanically linked to said loop track section, wherein movement of said target flag away from said first target flag position causes movement of said loop track section towards said second loop track section position.

2. The toy racetrack of claim 1, wherein said target flag is spring biased towards an upright position.

3. The toy racetrack of claim 2, further comprising a catch in said support tower holding said target flag in said first target flag position and releasing said target flag from said first target flag position after said target flag is struck by a toy vehicle launched from said toy vehicle launch section.

4. The toy racetrack of claim 1, herein the loop track section has an open central portion, the loop track section is in an upright position in its first position, and the open central portion of the loop track section faces the toy vehicle launch section when the loop track section is in its first position.

5. The toy racetrack of claim 1, wherein the first position of the loop track section is higher than the second position of the loop track section relative to the support tower, and the loop track section rotates 90 degrees as it moves from its first position to its second position.

6. A toy racetrack comprising:

a toy vehicle launch section;

a support tower positioned a distance away from the toy vehicle launch section, the support tower including a fixed lower tower section and an upper tower section pivotally mounted to the lower tower section;

a loop track section pivotably mounted to the support tower for movement between a first position in which the loop track section does not engage the toy vehicle launch section and a second position in which the loop track section forms a continuous track portion at an exit end of the toy vehicle launch section, the loop track section being pivotably mounted to the upper tower section;

a target flag pivotably mounted to the support tower, the target flag haying a first target flag position; and a catch holding the upper tower section in an upright position when the target flag is in its first target flag position.

7. The toy racetrack of claim 6, wherein said target flag is mechanically linked to said catch, wherein movement of said target flag away from said first target flag position releases said catch to avow said upper tower section to pivot with respect to said lower tower section.

8. The toy racetrack of claim 6, wherein the loop track section has an open central portion, and the open central portion of the loop track section faces the toy vehicle launch section when the loop track section is in its first position.

9. The toy racetrack of claim 6, wherein the loop track section rotates 90 degrees as it moves from its first position to its second position.

10. The toy racetrack of claim 9, wherein the loop track section has an open central portion, and when the loop track section is oriented in its first position, the open central portion faces the toy vehicle launch section.

11. A toy racetrack comprising:

a toy vehicle launch section;

a support tower positioned a distance away from the toy vehicle launch section, the support tower including a fixed lower section and an upper tower section pivotally mounted to the lower tower section;

a target pivotahly mounted to the support tower, the target flap having a first position;

a catch holding the upper tower section in an upright position when the target flag is in its first position; and a loop track section pivotally mounted to the support tower for movement between a first position in which the loop track section does not engage the toy vehicle launch section and a second position in which the loop track section forms a continuous track portion at an exit end of the toy vehicle launch section, the loop track section being pivotally mounted to the upper tower section, wherein the target flag is mechanically linked to the catch, and movement of the target flag by a toy vehicle releases the catch to allow the upper tower section to pivot with respect to the lower tower section.

12. The toy racetrack of claim 11, wherein the target flag is in alignment with an exit end of said toy vehicle launch section when said loop track section is in said first loop track section position.

13. The toy racetrack of claim 11, further comprising a toy vehicle catch tray attached to said support tower.

14. The toy racetrack of claim 13, wherein said toy vehicle catch tray is positioned to catch a toy vehicle that is launched from said toy vehicle launch section when said loop track section is in said second loop track section position.

15. The toy racetrack of claim 11, wherein the loop track section has an open central portion.

16. The toy racetrack of claim 15, wherein the loop track section is in an upright stored position in its first position, and the open central portion of the loop track section faces the toy vehicle launch section.

17. The toy racetrack of claim 11, wherein the first position of the loop track section is higher than the second position of the mop track section relative to the support tower.

18. The toy racetrack of claim 17, wherein the loop track section rotates 90 degrees as it moves from its first position to its second position.

19. The toy racetrack of claim 18, wherein the loop track section has an open central portion.

20. The toy racetrack of claim 19, wherein the open central portion faces the toy vehicle launch section when the loop track section is in its first position.

* * * * *